US006165078A

United States Patent [19]

Holt

[11] Patent Number: 6,165,078

[45] Date of Patent: Dec. 26, 2000

[54] ILLUMINATED POOL CUE

[76] Inventor: Samuel H. Holt, 210 E. Lake Ave., Barberton, Ohio 44203

[21] Appl. No.: 09/283,853

[22] Filed: Apr. 1, 1999

[51] Int. Cl.[7] ..... A63D 15/08

[52] U.S. Cl. ..... 473/44

[58] Field of Search ..... 473/44–49; 362/32, 362/102, 109, 120

[56] References Cited

U.S. PATENT DOCUMENTS

| | | | |
|---|---|---|---|
| 3,917,264 | 11/1975 | Davidson et al. | 473/46 |
| 4,688,796 | 8/1987 | Wright | 473/44 |
| 5,181,718 | 1/1993 | Valentine | 473/45 |
| 5,554,075 | 9/1996 | Glazer | 473/46 |
| 5,586,403 | 12/1996 | Ward | 43/17.5 |
| 5,653,640 | 8/1997 | Shirley, Jr. | 473/2 |
| 5,738,433 | 4/1998 | Sparks | 362/109 |
| 5,941,778 | 8/1999 | Vasalech | 473/44 |

FOREIGN PATENT DOCUMENTS

| | | | |
|---|---|---|---|
| 2276825 | 10/1994 | United Kingdom | 473/44 |

*Primary Examiner*—Mark S. Graham

*Attorney, Agent, or Firm*—Renner, Kenner, Greive, Bobak, Taylor & Weber

[57] ABSTRACT

An illuminated pool cue (10) includes a shaft (11) having an internal light source (24) and at least one transparent section (32) along its length. Activating the internal light source (24) illuminates the transparent section (32) and thereby provides an illuminated pool cue (10) having a novel appearance. More than one internal light source (24, 44) and associated transparent section (34, 50) may be employed as desired, and the light sources (24, 44) may be manually operated by switches (30, 48). When a common two-piece pool cue is used to practice the present invention, the light sources (218, 318) may be designed in such a manner as to light up upon joining the two pieces of the cue. To help maintain proper balancing of the pool cue, the light sources (218, 318) are preferably provided in the mid-section of the cue. To protect the light sources (218, 318) from damage due to impact forces encountered when the pool cue is used, foam sleeves (26, 46) are provided around the light sources, or springs (210) may be provided.

12 Claims, 3 Drawing Sheets

ILLUMINATED POOL CUE

TECHNICAL FIELD

The present invention relates generally to a pool cue and more particularly to an illuminated pool cue. More specifically, this invention relates to a pool cue having a transparent section and an internal light source that, when activated, causes light to shine through the transparent section to provide the illuminated pool cue.

BACKGROUND ART

Many types of pool cues used to play the game of billiards or pool are known in the art. Those skilled in pool often take pride in their special cues with one competitor often trying to psychologically outdo another competitor by arriving at the match with a cue having a special physical appearance. Typically, this special physical appearance relates to the types of wood grains used, the inlay of special designs along the cue, or other custom features for which the billiard player often spends vast sums of money in the purchase of a specific pool cue over another cue of similar quality. However, no one has previously considered providing a pool cue which can be provided with illuminated portions, despite the pride that such would bring to the player desiring a cue unique to the competition. Such an illuminated cue is likely heretofore unknown because of the potential problems in its construction.

One such problem is that, when considering an illuminated pool cue, the structural aspects of the common pool cue must be retained to assure accurate performance. Therefore, the provision of a light source in the cue and the formation of a portion of the cue with a transparent section should not substantially alter the design aspects, longevity, and balancing of the common pool cue.

As to the design aspects, pool cues are commonly designed in either a one-piece or two-piece construction. A one-piece pool cue is basically a single unit from the tip end to the butt end, while the two-piece cue consists of a tip half and a butt half which are releasably joined at the mid-section of the pool cue. In designing an illuminated pool cue, it is desirable to consider features which can be incorporated into either design.

The provision of an internal light source within the pool cue can present other problems in that, when in use, pool cues are subject to large forces, such as those arising from impact with the billiard balls or the floor, and these forces may be detrimental to the longevity of the light source. Also, as with any power source, the light source will eventually expire and need replacement. Therefore, ways to preserve the longevity of the illuminated pool cue by allowing for the replacement of the light source and protecting the light source from impact forces are important to the present invention.

Perhaps the most important feature of a quality pool cue is its balancing. Indeed, precision in the distribution of weight along the pool cue's length is a large factor in the quality and expense of a pool cue. The provision of a light source within a pool cue will necessarily create concerns as to the weight distribution in the illuminated pool cue.

In addition, it should be appreciated that the incorporation of a light source into a pool cue will also require the incorporation of a means to activate the light source into the design. Such is complicated by the fact that the internal light source may be incorporated into a pool cue that is of one-piece construction or a pool cue of two-piece construction.

Thus, when considering designing an illuminated pool cue, one must take into consideration factors of maintaining the accuracy and balance of the cue, protecting the light source from damage, and activating as well as replacing the light source. All of these concerns must be accommodated for either a one-piece or a two-piece cue.

DISCLOSURE OF THE INVENTION

It is therefore an object of the present invention to provide an illuminated pool cue having an internal light source and at least one transparent section, wherein the light source, when activated, causes a light to shine through the transparent section.

It is another object of the present invention to provide an illuminated pool cue, as above, that protects the light source from the forces which impact the pool cue when the pool cue is utilized for its intended purpose.

It is still another object of the present invention to provide an illuminated pool cue, as above, that allows for replacement of the light source to preserve the longevity of the illuminated pool cue.

It is yet another object of the present invention to provide an illuminated pool cue, as above, that provides desired weight distribution along the length of the pool cue despite the existence of the light source and the transparent section.

It is a further object of the present invention to provide an illuminated pool cue, as above, wherein the pool cue is a two-piece pool cue joinable at its mid-section, and the joining of the two pieces causes the light source to activate.

These and other objects of the present invention, as well as the advantages thereof over existing prior art forms, which will become apparent from the description to follow, are accomplished by the improvements hereinafter described and claimed.

In general, a pool cue made in accordance with one embodiment of the present invention includes a shaft with a light source positioned therein. The shaft has at least one transparent section positioned adjacent to the light source such that activating the light source illuminates the transparent section.

Other objects of the present invention are accomplished by another embodiment which includes a shaft having a first section which releasably engages a second section at generally the midpoint of the shaft. A light source is retained within the first section and is activated by the joining of the two shaft sections. A transparent section is formed in the first shaft section such that when the shaft sections are engaged to form the shaft, thereby activating the light source, the transparent section is illuminated.

Preferred exemplary illuminated pool cues incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
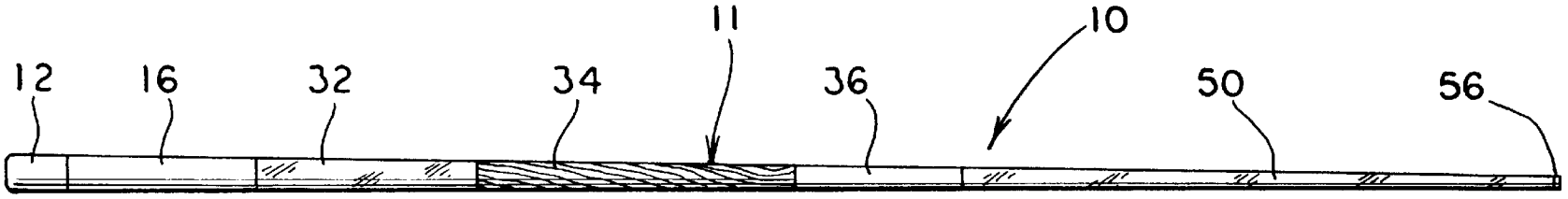
FIG. 1 is an elevational view of a pool cue made in accordance with one embodiment of the present invention.
Figure 2:
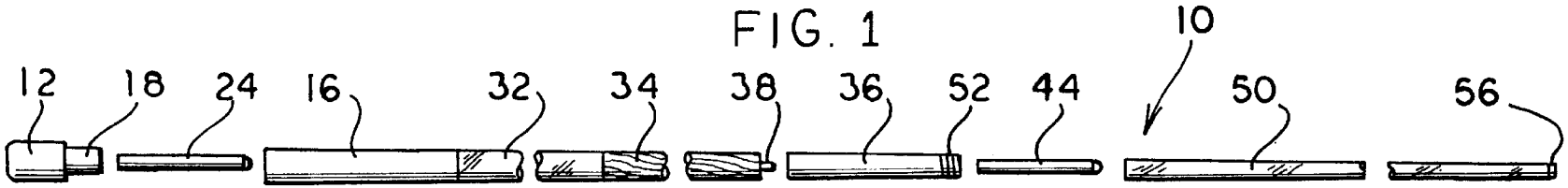
FIG. 2 is an exploded view of the pool cue shown in FIG. 1 showing the components thereof.
Figure 3:
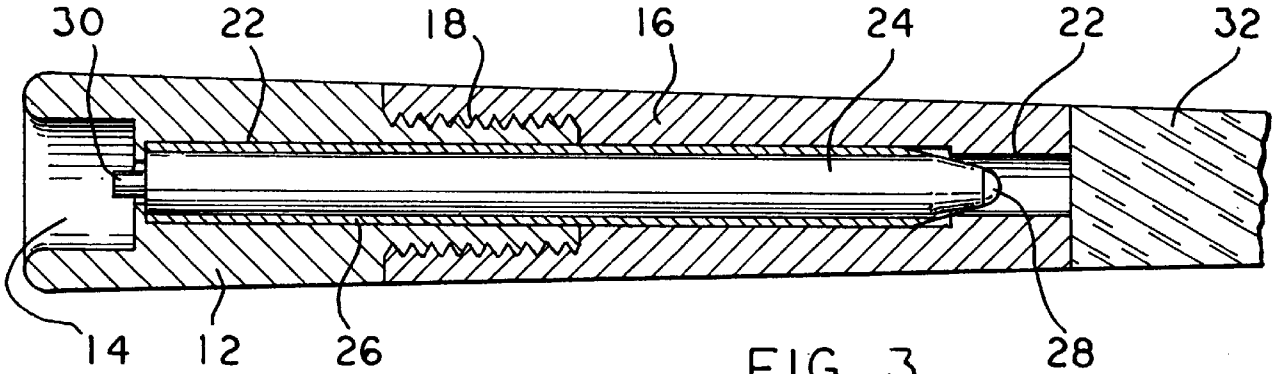
FIG. 3 is an enlarged, fragmented, partially sectioned view depicting the internal light source located in the butt end of the of the pool cue of FIG. 1.

One embodiment of the present invention is shown in FIGS. 1–4. There the illuminated pool cue of the present invention is designated generally by the numeral 10. Pool cue 10 includes an elongate shaft, generally indicated by the numeral 11, having a butt 12 at one end thereof. Butt 12 has a recess 14 therein and engages a butt light housing 16 positioned adjacent thereto by means of interacting threads 18. Butt 12 and butt light housing 16, when joined, form a hollow core 22 which retains a light source 24. Light source 24 is both retained and protected within hollow core 22 by a sleeve 26. Sleeve 26 is preferably an open or closed cell foam tubular member, however, other materials or devices which would retain and protect light source 24 may be utilized.

In this embodiment, light source 24 is shown as being a disposable, replaceable light stick having a lightbulb 28 and a switch 30. As can be seen most clearly in FIG. 3, light source 24 is retained in hollow core 22 such that switch 30 extends into recess 14 and lightbulb 28 is retained adjacent transparent section 32. Recess 14 provides access to switch 30 so that light source 24 may be activated to cause lightbulb 28 to shine light through transparent section 32. When light source 24 is spent, it may be replaced by disengaging threads 18 and placing a new light source 24 into hollow core 22.

Transparent section 32 is fixedly joined to butt light housing 16 by a suitable adhesive and is preferably joined by a combination of a threaded engagement and an adhesive. The threads joining transport section 32 and butt light housing 16 would be similar to threads 18 but would be initially joined with an adhesive placed on the threads so that when the adhesive dried the engagement would be fixed. Transparent section 32 is positioned adjacent lightbulb 28 so that a majority of the light shining from lightbulb 28 is directed through transparent section 32. Transparent section 32 is preferably made from a clear polycarbonate; however, the present invention is not limited thereto, and it should be realized that any transparent material may be utilized. Furthermore, it is not necessary that all of transparent section 32 be transparent. Transparent section 32 could be substantially opaque, with only various portions along its length being transparent. In this manner, transparent section 32 could be made to provide transparent designs which would light up when light source 24 is activated. Indeed, transparent section 32 could also contain mirrors, prisms, or any other device which tends to bend, separate, or otherwise distort or play with light to provide various visual effects.

Figure 4:
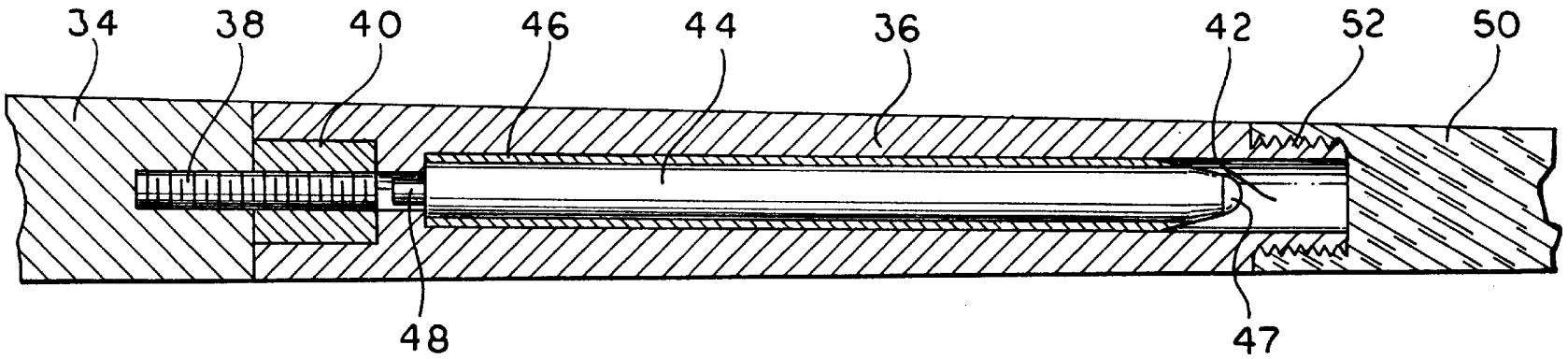
FIG. 4 is an enlarged, fragmented, partially sectioned view depicting the manner in which a second light source may be located along the length of the pool cue.

In instances where a two-piece cue 10 is provided, transparent section 32 is connected to shaft mid-section 34 which, as can be seen most clearly in FIG. 4, releasably engages shaft light housing 36 by means of screw 38 and internally threaded bushing 40. Screw 38 and bushing 40 are commonly used in the art to provide such a two-piece pool cue; however, a one-piece pool cue can be provided wherein mid-section 34 is a continuous unitary piece extending to shaft light housing 36 as is also common in the art. Similar to butt light housing 16, shaft light housing 36 has a hollow core 42 wherein a light source 44 may be retained and protected by sleeve 46. Lightbulb 47 is activated by switch 48 and projects light through transparent section 50 which releasably engages shaft light housing 36 by means of interacting threads 52. Transparent section 50 preferably ends at tip 56, however, transparent section 50 need not extend so far and could be joined to an opaque section before tip 56.

It should be evident that pool cue 10 could be constructed with either transparent section 32 or transparent section 50 or both (as shown in FIGS. 1–4). If both transparent section 32 and 50 are to be employed, it is preferred, for the reasons given hereinbelow, that the pool cue 10 be of a two-piece construction capable of being disassembled at its midpoint by means of screw 38 and bushing 40. It should be understood that the terms "one-piece" and "two-piece" construction do not take into account the various sections of pool cue 10 which may be disassembled to access light sources 24, 44. The term "two-piece construction" is used herein to refer to an embodiment of pool cue 10 that is releasably engaged at its midpoint through screw 38 and bushing 40, and the term "one-piece construction" is used herein to refer to an embodiment of pool cue 10 that does not releasably connect at its midpoint.

As mentioned above, the two-piece construction is preferable when both transparent sections 32 and 50 are employed. This construction is preferred because it allows for easier access to activate light source 44 in shaft light housing 36. In the two-piece construction, screw 38 and bushing 40 may be disengaged and bushing 40 may be provided with a hole which allows for access, by means of a stick or other small object, to activate switch 48. Alternatively, a two-piece pool cue could be constructed wherein screw 38 contacts switch 48 and activates light source 44 upon complete connection of screw 38 with bushing 40. Employing both transparent sections 32 and 50 in a one-pieced pool cue would require disengaging transparent section 50 from shaft light housing 36 in order to remove light source 44 before activating it and replacing it back into hollow core 42.

Figure 5:
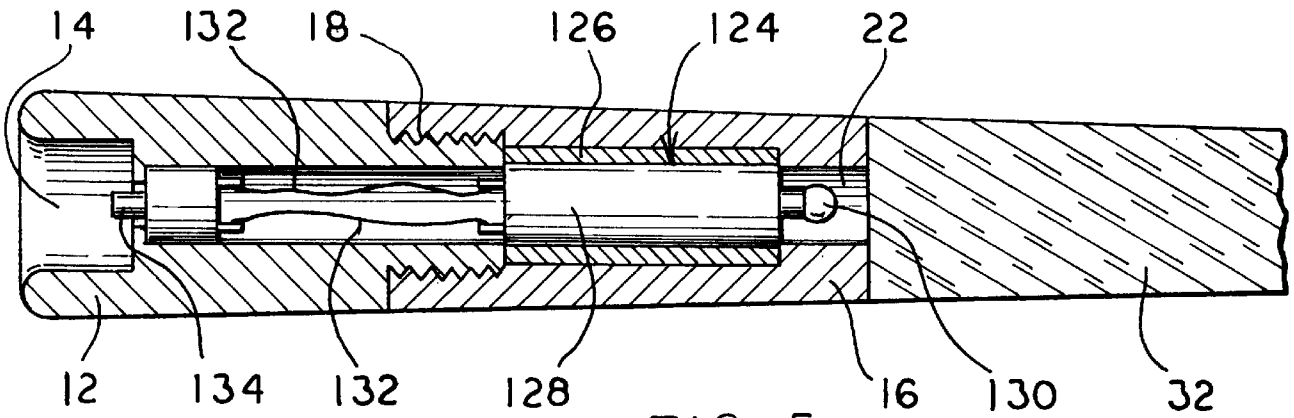
FIG. 5 is an enlarged, fragmented, partially sectioned view depicting an alternate embodiment of a light source for use in the present invention.

While a particular type of light source, shown as light sources 24 and 44, have been disclosed hereinabove, it should be understood that the present invention is not limited to a specific type of light source. For example, referring now to FIG. 5, it can be seen that other types of light sources are contemplated by the present invention. In this embodiment, a light source, generally indicated by the numeral 124, is protected and retained in hollow core 22 by a sleeve 126. Light source 124 includes a battery pack 128 connected to a lightbulb 130, battery pack 128 being connected by wires 132 to a switch 134 which can be accessed through recess 14. This alternate embodiment of a light source is recited as an example to show that the present invention should not be limited to any particular light source inasmuch as there are a multitude of ways to provide butt light housing 16 and shaft light housing 36 with an internal source of light. As a further example, the present invention contemplates the use of laser pointer devices as the light sources. The common laser pointer is a cylindrical device similar to light sources 24, 44 and has an activation button that protrudes from its side wall such that, upon insertion of the laser pointer into hollow core 22 or 62, the laser pointer would activate because the wall of the hollow core would press down on the activation button. Again, this alternative light source is disclosed as an example only, and the present invention should not be limited thereby. Indeed, the present invention also contemplates an embodiment wherein pool cue 10 is placed in a display rack wherein the light sources within pool cue 10 are powered through a direct connection with an electrical outlet.

The embodiments described hereinabove are very practical in that they provide a pool cue 10 that is simple to construct and has light sources 24, 44 and 124 which are easy to replace; however, the provision of a light source in butt light housing 16 may be impractical when attempting to construct a very high quality cue having a satisfactory weight distribution along its length. When constructing higher quality cues with precise weight distributions, it has been found that it its preferable to place the light source within midsection 34 so that the light source does not cause one end of the pool cue to be out of balance with the other. Also, it is preferable that the light sources placed within pool cue 10 be self-activating such that one using illuminated pool cue 10 need not manually activate a switch to turn on those light sources. The embodiment described hereinbelow provides a pool cue of a two-piece construction which retains its light source within mid-section 34 and activates its light simply upon engagement of the two cue pieces which join to form the pool cue.

Figure 6:
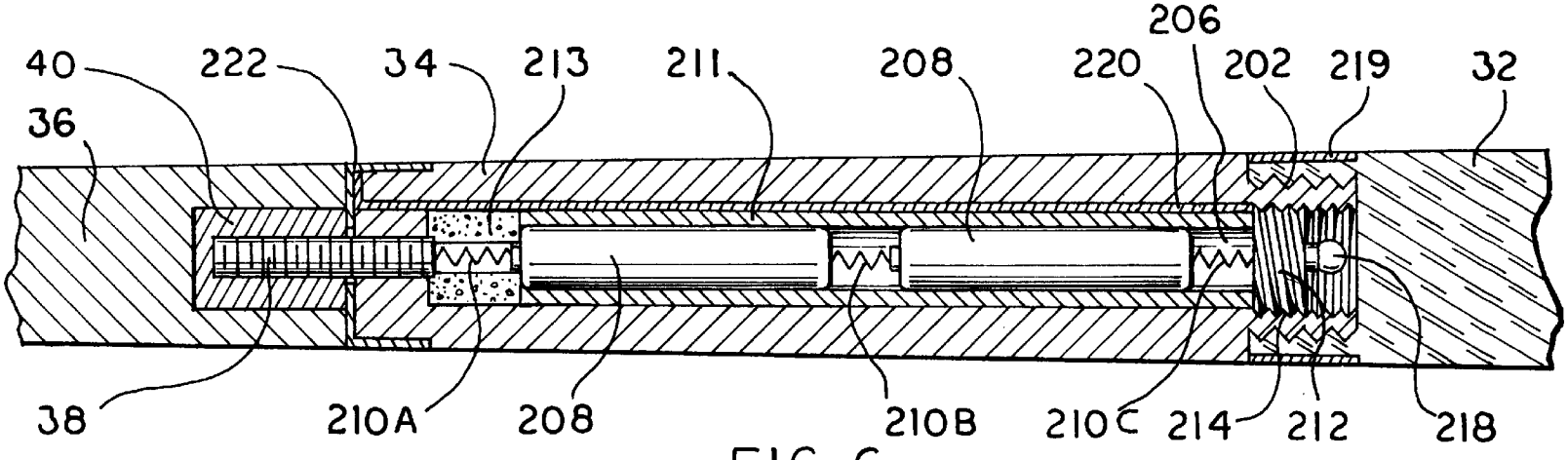
FIG. 6 is an enlarged, fragmented, partially sectioned view depicting an alternate embodiment of a light source for use in the present invention in which the light source is located in the mid-section of the pool cue and activates upon the joining of a pool cue two halves.
Figure 7:
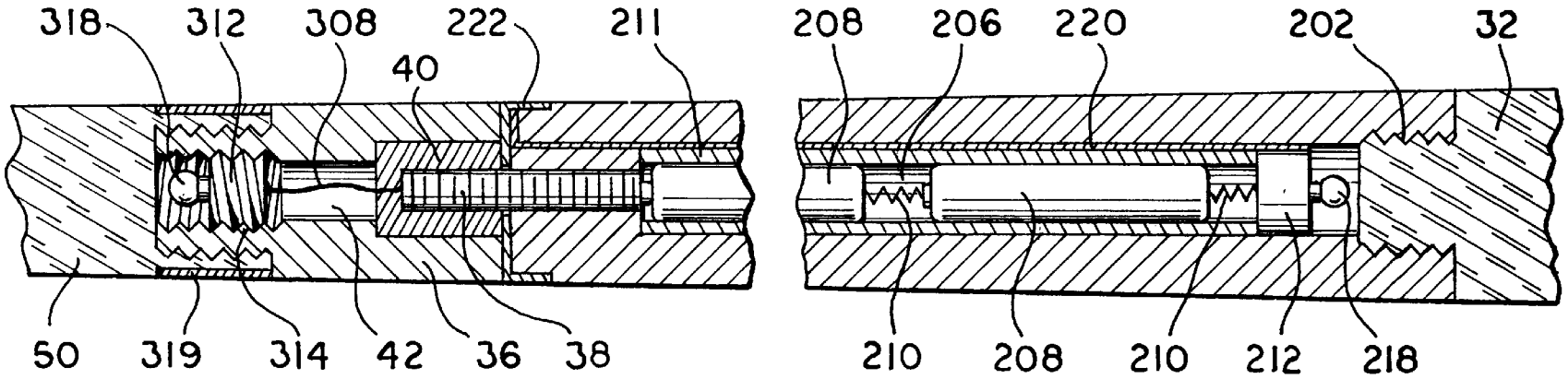
FIG. 7 is an enlarged, fragmented, partially sectioned view similar to FIG. 6 but depicting a light source for the pool cue in which two separate light sources are activated by the same power source when the two halves of the pool cue are joined.

Thus, FIGS. 6 and 7 depict another embodiment of the illuminated pool cue 10 of the present invention. In this embodiment, the light source, the component parts of which will be described hereinbelow, is retained within mid-section 34, and the separate butt light housing 22 is therefore not necessary and transparent section 32 may, if desired, extend all the way to butt 12.

In the embodiment of FIG. 6, mid-section 34, through interacting threads 202, engages transparent shaft section 32. A hollow core 206 retains batteries 208 which are connected by springs 210. Springs 210 are capable of conducting the energy of batteries 208, and also serve to absorb impact forces when pool cue 10 is used. For this reason, springs 210 are preferably surrounded by a soft open or closed cell foam sleeve 213 that will substantially aid in lessening the impact on batteries 208. While sleeve 213 is shown in FIG. 6 as only being provided for spring 210A, it is to be understood that preferably a sleeve 213 is provided for all springs 210 shown in FIGS. 6 and 7. As a result, the embodiment of FIG. 6 does not necessarily require a sleeve around batteries 208 such as sleeves 26, 46. However, a sleeve 211 has been shown in FIGS. 6 and 7 and can optionally be provided. But if sleeve 211 is not provided, hollow core 206 can be sized to allow for very little empty space between the wall of hollow core 206 and batteries 208. As discussed above, springs 210 will then provide the needed protection to batteries 208 and also ensure that batteries 208 will remain connected although they may be subjected to impact forces when pool cue 10 is used. Spring 210A connects batteries 208 to screw 38, spring 210B is connected between batteries 208, and spring 210C connects batteries 208 to a light holder 212.

Light holder 212 closes off hollow core 206 by removably engaging mid-section 34 by means of interacting threads 214. Light holder 212 also retains lightbulb 218 within transparent shaft section 32. Because light holder 212 is retained within transparent section 32, it will be visible therethrough unless steps are taken to hide light holder 212. Therefore, it is preferred that transparent section 32 include an opaque section 219 around the area overlapping light holder 212 in order to cover an undesirable view of light holder 212 through transparent section 32.

A wire 220 extends from intimate contact with light holder 212 at threads 214 to also intimately contact collar 222. Collar 222 surrounds, but does not touch, screw 38, there being a distance of about ⅛ inch therebetween. However, collar 222 contacts bushing 40 when an engagement between screw 38 and bushing 40 is made. Screw 38, bushing 40, springs 210, light holder 212, wire 220 and collar 222 are all formed from metals or other materials capable of conducting the power of batteries 208. Therefore, engaging screw 38 with bushing 40, so that collar 222 contacts bushing 40, creates a closed circuit causing lightbulb 218 to be activated by batteries 208.

Turning now to FIG. 7, it can be seen how the embodiment of FIG. 6 may be modified to allow for the illumination of transparent shaft section 50. In this embodiment, hollow core 42 of shaft light housing 36 retains light holder 312 through interacting threads 314 as described hereinabove with respect to light holder 212. A wire 308 connects light holder 312 to bushing 40 such that, when collar 222 connects with bushing 40 to create a complete circuit as described hereinabove, lightbulb 318 is activated so that light shines through transparent section 50. As described hereinabove, transparent section 50 also preferably provides an opaque section 319 to hide light holder 312 retained within transparent section 50. However, an alternative version of the connection between shaft mid-section 34 and transparent section 32 is shown in FIG. 7. In this version, transparent section 32 includes external threads 202, and since mid-section 34 surrounds it, opaque section 219 shown in FIG. 6 is not necessary.

In light of the foregoing, it should thus be evident that an illuminated pool cue constructed as described herein substantially improves the art and otherwise accomplishes the objects of the present invention.

What is claimed is:

1. A pool cue comprising a shaft having a hollow core, and a light source positioned within said hollow core of said shaft, said shaft having at least one transparent section forming a portion of the external surface area of said shaft and positioned adjacent to said light source such that activating said light source illuminates said transparent section thereby illuminating a portion of the external surface area of said shaft.

2. A pool cue according to claim 1 wherein said shaft may be disassembled at said hollow core to provide access to said light source.

3. A pool cue comprising a shaft having a hollow core; a first light source positioned within said hollow core of said shaft; a sleeve in said hollow core to protect said first light source; a first transparent section positioned adjacent to said first light source; a second light sources and a second transparent section positioned adjacent said second light source such that activating said first light source illuminates said first transparent section, and activating said second light source illuminates said second transparent section.

4. A pool cue according to claim 3 wherein said second light source is retained within a second hollow core formed in said shaft, and further comprising a sleeve in said second core to protect said second light source.

5. A pool cue according to claim 3 wherein said shaft may be disassembled at said hollow core to provide access to said first light source, and wherein said shaft may be disassembled at said second hollow core to provide access to said second light source.

6. A pool cue comprising a shaft having a first section releasably engaging a second section at generally the mid-point of said shaft, a light source retained within said first section, said light source being activated by the joining of said first section and said second section, and a transparent section positioned in said first section such that when said first section and said second section are engaged to form said shaft and activate said light source, said transparent section is illuminated.

7. A pool cue according to claim 6 wherein said first and second sections of said shaft are releasably engaged by an electrically conductive screw provided by said first section and a electrically conductive threaded bushing provided by said second section.

8. A pool cue according to claim 7 wherein said light source includes at least one battery connected to said screw by a first electrically conductive spring, an electrically conductive light holder connected to said at least one battery by a second electrically conductive spring, said light holder including a light bulb and intimately contacting a first electrically conductive wire connected to an electrically conductive collar on said first section, said collar being capable of intimately contacting said threaded bushing when said first and said second section are engaged such that a complete circuit is created between said at least one battery and said light bulb.

9. A pool cue according to claim 6 further comprising a second light source retained within said second section, said second light source being activated by the joining of said first section and said second section, a second transparent section positioned in said second section such that when said first section and said second section are engaged to form said shaft and activate said second light source, said second transparent section is illuminated.

10. A pool cue according to claim 9 wherein said first and second sections of said shaft are releasably engaged by an electrically conductive screw provided by said first section and a electrically conductive threaded bushing provided by said second section.

11. A pool cue according to claim 10 wherein said light source includes at least one battery connected to said screw by a first electrically conductive spring, an electrically conductive light holder connected to said at least one battery by a second electrically conductive spring, said light holder including a light bulb and intimately contacting a first electrically conductive wire connected to an electrically conductive collar on said first section, said collar being capable of intimately contacting said threaded bushing when said first and said second section are engaged such that a complete circuit is created between said at least one battery and said light bulb.

12. The pool cue according to claim 11 wherein said second light source includes a second electrically conductive wire connected to said threaded bushing and connected to a second electrically conductive light holder, said light holder including a second light bulb, such that when said collar intimately contacts said threaded bushing a complete circuit is created between said at least one battery and said second light bulb.

* * * * *